US006019374A

United States Patent [19]

Breeding

[11] Patent Number: 6,019,374

[45] **Date of Patent: *Feb. 1, 2000**

[54] MULTI-TIERED WAGERING METHOD AND GAME

[75] Inventor: John G. Breeding, Eden Prairie, Minn.

[73] Assignee: Shuffle Master, Inc., Eden Prairie, Minn.

[ * ] Notice: This patent is subject to a terminal disclaimer.

[21] Appl. No.: 08/970,966

[22] Filed: Nov. 14, 1997

Related U.S. Application Data

[63] Continuation of application No. 08/695,640, Aug. 12, 1996, abandoned, which is a continuation-in-part of application No. 08/388,292, Feb. 14, 1995, Pat. No. 5,544,892, which is a continuation of application No. 08/043,413, Apr. 6, 1993, Pat. No. 5,417,430, which is a continuation-in-part of application No. 08/023,196, Feb. 5, 1993, Pat. No. 5,288,081.

[51] Int. Cl.[7] ..... A63F 1/00

[52] U.S. Cl. ..... 273/292

[58] Field of Search ..... 273/292, 309, 273/274; 463/12, 13, 25–28

[56] References Cited

U.S. PATENT DOCUMENTS

| | | | |
|---|---|---|---|
| 3,876,208 | 4/1975 | Wächtler et al. | 463/13 |
| 4,305,586 | 12/1981 | Richards | 273/274 |
| 4,651,997 | 3/1987 | Wood | 273/274 |
| 4,743,022 | 5/1988 | Wood | 463/13 |
| 4,756,531 | 7/1988 | DiRe et al. | 463/18 |
| 4,836,546 | 6/1989 | DiRe et al. | 463/18 |
| 4,836,553 | 6/1989 | Suttle et al. | 273/292 |
| 4,861,041 | 8/1989 | Jones et al. | 273/292 |
| 4,948,134 | 8/1990 | Suttle et al. | 463/13 |
| 5,019,973 | 5/1991 | Wilcox et al. | 364/412 |
| 5,022,653 | 6/1991 | Suttle et al. | 463/13 |
| 5,042,818 | 8/1991 | Weingardt | 463/13 |
| 5,078,405 | 1/1992 | Jones et al. | 273/309 |
| 5,098,107 | 3/1992 | Boylan et al. | 273/292 |
| 5,100,137 | 3/1992 | Fulton | 463/13 |
| 5,167,413 | 12/1992 | Fulton | 463/13 |
| 5,275,400 | 1/1994 | Weingardt et al. | 463/12 |
| 5,288,077 | 2/1994 | Jones | 273/292 |
| 5,288,081 | 2/1994 | Breeding | 273/292 |
| 5,544,892 | 8/1996 | Breeding | 273/292 |

OTHER PUBLICATIONS

Scarne's Encyclopedia of Games, John Scarne, Harper & Row Publishers, pp. 33–41, and 381 1973.

Michigan Legionnaire, Wild Deuces Michigan Lottery, p. 15, Oct. 1978.

(List continued on next page.)

*Primary Examiner*—Benjamin H. Layno

*Attorney, Agent, or Firm*—Dorsey & Whitney LLP

[57] ABSTRACT

A multi-tiered wagering game and method, including a playing card wagering game, involves placing a first game wager and an optional second wager and/or entry fee to participate in the multi-tiered game. Cards are dealt by the dealer, two face down to the dealer and three face down to each player. Players inspect or "sweat" their cards and the dealer gives each player the opportunity to withdraw one part of the bet. Each player decides and the dealer then turns over one of the cards and again gives each player the opportunity to withdraw a second part of the bet. The players decide, their cards are shown, and based on the shown cards the remaining game wagers are resolved. Also based on the shown cards, players that placed the optional second wager and/or entry fee become eligible for bonus payouts and/or to become eligible to participate in a second game to determine the winner of a super jackpot, respectively.

24 Claims, 2 Drawing Sheets

OTHER PUBLICATIONS

"Over/Under 13"™, Gaming Concepts, Inc., 1988 (deposit for copyright registration TX 2–505–726).

Scarnes Encyclopedia of Card Games, John Scarne. ©1973 ("Pontoon", p. 288, "Scarney Baccarat"®, pp. 299–304, and "Three–In–One", p. 383).

"Big Field," described in Declaration of Jim Kilby May 1995, cited in Reexamination Proceeding Control No. 90/003,865.

"Working Within the Systems," Roger Gros, Casino Journal, pp. 10–13, 15 and 40–41, Dec. 1992.

Second Amendment to Petition filed Aug. 4, 1992 in State of New Jersey, Casino Control Commission, PRN 217205.

Jim Kilby Declaration under 37 C.F.R. § 1.132 dated Mar. 22, 1995.

Scarne's Encyclopedia of Games pp. 11, 12 288, 298–305.

Anchor Games brochure for "Wheel of Gold" (11 pages-)describing the Wheel of Gold game. Includes drawings and written explanation.

MULTI-TIERED WAGERING METHOD AND GAME

This is a file wrapper continuation of application Ser. No. 08/695,640, filed Aug. 12, 1996, now abandoned, which is in turn a continuation in part of application Ser. No. 08/388,292, filed Feb. 14, 1995, now U.S. Pat. No. 5,544,892, in turn a continuation of application Ser. No. 08/043,413, filed Apr. 6, 1993, now U.S. Pat. No. 5,417,430, in turn a continuation in part of application Ser. No. 08/023,196, filed Feb. 5, 1993, now U.S. Pat. No. 5,288,081.

TECHNICAL FIELD

The present invention relates to multi-tiered wagering games. In particular, it relates to a method and apparatus for playing a game to determine the winner of a super jackpot, wherein the game may be played in conjunction with other wagering games, such as poker games.

BACKGROUND ART

There are many wagering games used for gambling. Such games should be exciting to arouse players' interest and uncomplicated so they can be understood easily by a large number of players. Ideally, the games should include more than one wagering opportunity during the course of the game, yet be able to be played rapidly to a wager resolving outcome. Exciting play, the opportunity to make more than one wager and rapid wager resolution enhance players' interest and enjoyment because the frequency of betting opportunities and bet resolutions is increased.

Wagering games (e.g., roulette, craps, slots, video poker, table card games, and game machines or computers using gaming software), including those intended primarily for play in casinos, should provide players with a sense of participation and control, the opportunity to make decisions, and reasonable odds of winning, even though the odds favor the casino, house, dealer or banker. The game must also meet the requirements of regulatory agencies.

Wagering games, including wagering games for casino play, with multiple wagering opportunities are known. U.S. Pat. Nos. 4,861,041 and 5,087,405 (both to Jones et al.) disclose methods and apparatus for progressive jackpot gaming, respectively. The former patent discloses that a player may make an additional wager at the beginning of a hand, the outcome of the additional wager being determined by of a predetermined arrangement of cards in the player's hand. U.S. Pat. No. 4,836,553 (to Suttle and Jones) discloses a modified version of a five card stud poker game.

Additional symbols may be added to the usual means of playing a game to increase wagering opportunities. This is disclosed in U.S. Pat. No. 5,098,107 (to Boylan et al.). Somewhat similarly, U.S. Pat. No. 3,667,757 (to Holmberg) discloses a board game and apparatus, including a way to allow the player to make a choice with respect to several different alternative types of game play and risk bearing strategies. The alternative play is based on providing cards with additional symbols and therefore, a new set of odds. The game and apparatus disclosed by Holmberg requires new sets of rules, relatively complicated procedures and time for a player to learn the game.

U.S. Pat. No. 5,154,429 (to LeVasseur) involves the dealer playing multiple hands against a player's single hand, whereby the number of hands played in the same amount of time is increased.

The desired attributes of wagering games outlined above are in large measure provided by the method and apparatus for a wagering game in accordance with the present invention. The game is uncomplicated, exciting and provides the opportunity for players to make multiple wagers, choices regarding those wagers and a separate wager and entry fee for a bonus pay-off and a super jackpot pay-off.

SUMMARY OF THE INVENTION

A multi-tiered wagering method and game is provided. The multi-tiered game and method involves placing a first wager and an optional second wager and/or entry fee to participate in the multi-tiered game, playing a first wagering game, the initial or basic game, to resolve the first wager and the second wager and to select a qualified player, or a group of qualified players or finalists, and playing a second game or additional games to select a winner or winners of a super jackpot. The second game or games occurs at a time measured by the occurrence of a selected event: after a predetermined number of qualifiers or finalists is determined, when the jackpot reaches a predetermined amount, or after a predetermined time period. When the occurrence of the second game or games is based on a predetermined number of qualifiers or finalists (e.g., one to one hundred), the frequency of play of the second game or games can be predicted based on mathematical hit frequencies. In card games such as poker, mathematical hit frequency or statistical hit frequency refers to a statistical relationship between the number of hands played and the random occurrence of a specific arrangement of cards (e.g., a royal flush). For example, the mathematical hit frequency for obtaining a royal flush in poker using a 52 card deck is 1:649,740. It should be understood that the concept of mathematical hit frequency is applicable to all games of chance. The second wagering game or additional games of the multi-tiered method and game includes one or more super jackpot pay-offs.

The present invention encompasses a series of games and a plurality of players participating alone or simultaneously with other players in a game or in games in the series. Games being played at a single gaming table in a single casino, at other gaming tables in a casino and at other gaming tables in other casinos in the same and in distant locations are interconnected by a computer network to determine winners and eligible participants to enter and complete tournament play to win super jackpot pay-offs. Players participating at gaming tables managed by a dealer and those participating on video equipment designed and programmed to accept bets, deal cards and register winning hands automatically can be interconnected to form a series of games played by a plurality of players leading to a final tournament with one or more super jackpot pay-offs.

The terms "predetermined" and "preselected" are intended to have their customary meaning, i.e., respectively, to determine beforehand and to choose in advance. More specifically, in the context of the present invention, they are intended to mean a determination of a pay-off or a selection of the arrangement of cards that constitutes a pay-off winning hand before a player begins to play. Thus, a predetermined pay-off or preselected arrangement(s) of cards will be determined or established by a casino or other game governing entity, by agreement among players or by the traditional rules of the game before any particular game or hand begins and remain fixed or constant for a plurality of bet resolutions. A predetermined pay-off may include a specific amount (e.g., $1,000,000) and it may include a specific multiple of the amount bet (e.g., 1,000:1). Whether including a specific amount or multiple of the amount bet, the predetermined pay-off remains constant for a duration of play or a plurality of bets, and does not increase or decrease as play continues or as each bet is resolved.

One wagering game, identified by the registered trademark LET IT RIDE® owned by the assignee of the present invention, for use with the multi-tiered wagering method and game of the present invention is played with a single, typical fifty-two card poker deck and broadly involves the generally well recognized and accepted set of rules, procedures and wager-resolving relationships and rankings of poker. The game method comprises each player placing an initial, three-part game wager to participate in the basic game. Each player may place an optional wager, of a fixed amount, and/or an entry fee to become eligible for bonus payouts and to become eligible to participate in a second game to determine the winner a super jackpot, respectively.

After wagers are placed, cards are dealt by a dealer, three down to each player and two down to the dealer. Players inspect or "sweat" their cards, and the dealer asks "take it or leave it?" with regard to a first part of the initial, three-part game wager to participate in the basic game. Players can choose to retrieve or remove from play the first part of their initial bet, or leave the first part in play or at risk, based on the value of the three cards in their hand. The dealer then turns over one of the dealer's cards and the dealer's query is repeated with regard to a second part of the initial bet. Players can choose to retrieve or remove from play the second part of their initial bet or leave the second part in play or at risk, based on the value of the four cards consisting of the three cards in the player's hand and the exposed dealer's card. Players have no option with the third part of the bet.

Finally, all cards are shown and the payouts and collections related to the basic game wager are resolved according to the ranking of the poker hand of each player, i.e., the players are not playing against each other or the dealer. If a player placed an optional second wager and/or entry fee thereby electing to participate in the bonus payout and super jackpot tournament aspects of the multi-tiered game, the ranking of that player's hand determines the outcome of that player's wager, including the bonus payout amount, if any, won by the player, and eligibility of the player to win the super jackpot tournament.

More specifically, with regard to the basic game, the initial wager placed by each player comprises three equal parts and is made or placed before any cards are dealt. Each player is dealt three cards face down in the customary fashion. Two common cards are dealt face down in front of the dealer for use by all of the players. Each player will use the two common cards in front of the dealer in combination with his or her three cards to create a five card hand. After all players have placed their bets and received and examined their three cards, each is given the opportunity to retrieve one-third of the initial wager before the dealer reveals one of the two down cards previously placed in front of him.

After all of the players have been queried and decided whether to take or leave the first part of the initial game wager, the dealer turns one of the down cards face up. Each player now has the benefit of four cards, the three he or she is holding down plus the common card, and the dealer again gives each player the opportunity to retrieve one-third of the beginning wager before exposing the second common down card. After the second common down card is revealed, the players turn up the three cards they are holding thereby forming a five card hand made up of the three cards dealt to each player and the two dealer cards.

The dealer examines each of the players' hands and determines what payout, if any, each player is entitled to receive according to that player's remaining portion of the initial game wager and a preselected payout schedule. Payouts are made to players with winning hands and the losing wagers are collected. The cards are then reshuffled for the next hand.

With regard to the super jackpot tournament or second game, players elect to participate before the cards are dealt for the basic game by paying a fixed entry fee included in a fixed side bet wager on the chance that their final five card hand will embody one of a number of predetermined designated poker hands. If a participating player's hand comprises one of the designated winning hands, that player wins a corresponding bonus payout amount, which is paid out immediately at the end of the hand. Further, if a participating player's hand comprises a further selected one of the predetermined winning hands, that player becomes eligible to participate in a second game, playoff or tournament to determine the winner of a super jackpot. The designated winning hands to determine the participants in the second game may correspond to traditional poker hands or card arrangements, but are not limited to any particular arrangements. In the preferred embodiment the designated winning hands to participate in the second game consist of a designated number, such as one hundred of the highest winning hands including ties registered by participating players over a given time period. Other numbers of highest winning hands, such as fifty or seventy-five could also be designated. In another variation, participants in the second game or qualifiers would consist of all hands of a predetermined rank or above over a given period of time (e.g., a straight flush or greater over a four month period).

The present invention encompasses an apparatus for playing the wagering game according to the method outlined above. A typical gaming table, with a playing surface, is modified to include specific areas that provide locations and apparatus for placing the wagers, including the optional bet and/or entry fee to participate in the super jackpot game, and for displaying the common cards. The apparatus may be adapted to include the progressive gaming apparatus disclosed in the U.S. patent application Ser. No. 08/041,850, invented by Breeding and Helgesen and commonly owned, the former inventor being the inventor of the present invention.

A card shuffling machine such as that disclosed in U.S. Pat. No. 4,807,884 (also invented by the inventor of the present invention and commonly owned) for facilitating and speeding the play of the wagering game may be used. A display device may be associated with the apparatus for displaying game information, including information about the jackpot aspect of the game.

It is an object of the present invention to provide a multi-tiered wagering game and method which may be played or practiced in conjunction with other wagering games or as a stand alone wagering game wherein a prospective participant wagers or pays a fixed amount to participate, wherein a random outcome determines a qualified player, or a group of qualified players or finalists from among the participants, and wherein a second random outcome, or subsequent random outcome, determines a winner.

It is another object of the present invention to provide an exciting and interesting wagering game that is easy to learn, largely being based on wagering games, including poker, and the well known ranking of poker hands, roulette, craps, slots, blackjack, twenty-one and the like.

It is another object of the present invention to provide a new variation of a well known wagering game, five card stud poker, which is made interesting by providing the opportunity for players to make multiple wagers and decisions related to those wagers based on the progress of the game, as well as the chance to win an immediate bonus payout and/or become eligible to win a super jackpot.

Still another object of the present invention is to provide a wagering game that is easy to learn, yet demands skill of players in making strategic decisions about whether to let part of their bet ride.

It is yet another object of the present invention to provide a unique, exciting wagering game for play in casinos, non-casino gaming environments, or at home and on various media including casino tables, video poker machines, video lottery terminals, interactive television or other broadcast systems, home computers, or networks such as the Internet.

It is an advantage of the game of the present invention that wagering decisions are inherent in the game. The game enhances players' sense of participation and takes advantage of players' inclination to let wagers ride once placed. Another advantage of the game is that the possibility of immediately winning a bonus payout, and/or becoming eligible to win a super jackpot of a substantial amount, makes the game more exciting and, therefore, more interesting to players.

DETAILED DESCRIPTION OF THE PREFERRED EMBODIMENT

Figure 1:
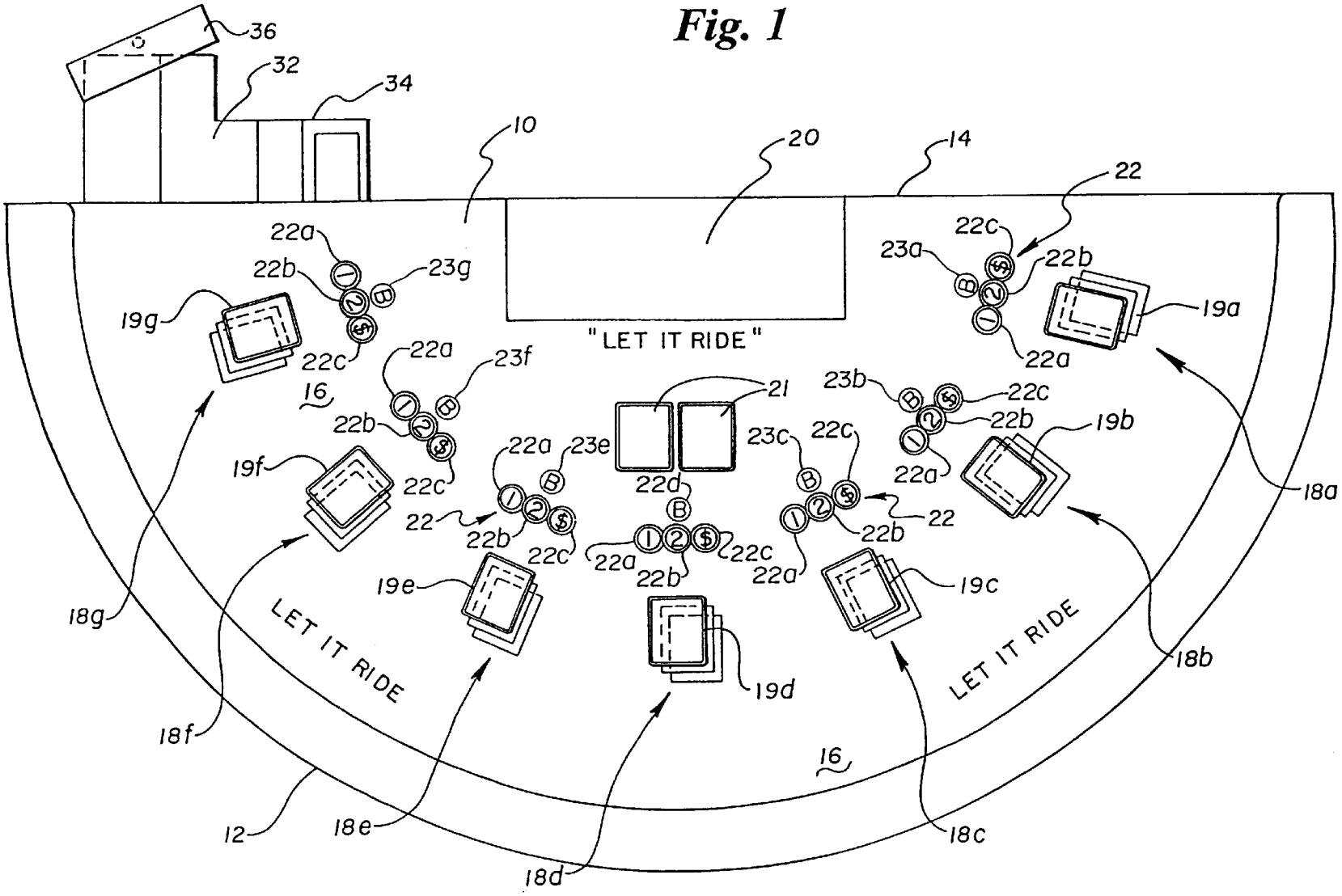
FIG. 1 depicts the table layout and apparatus used in playing the wagering game of the present invention.

Referring to FIG. 1, the apparatus for the wagering game of the present invention includes a typical casino gambling or gaming table 10. The table 10 has a curved side 12 for accommodating up to seven players and a straight side 14 for accommodating the dealer. The table 10 has a flat surface 16 covered with felt or other appropriate material. Although seven playing positions or locations 18*a–g* for individual players are provided, it is not essential to the game that exactly seven persons play and as many as sixteen players or as few as one may participate. For casino play, a field of seven players provides for a game that is easily manageable by the dealer and house, and one in which the individual players feel more involved. A house dealer position 20, including an area suitable for displaying the dealer's common cards 21, is provided.

Each of the playing positions 18*a–g* includes a wagering zone 22, comprising three separate and distinct wagering or betting areas 22*a, b, c*, for receiving or indicating a wager in the basic game. Each position 18*a–g* also includes a card area 19*a–g* for receiving and displaying cards dealt to the player occupying the position. A suitable wagering area or apparatus for receiving or indicating an optional second wager and/or entry fee in the bonus pay-off and the second game, playoff, or tournament is represented at area 23*a–g*. The wagering areas 22*a, b, c* and 23*a–g* may be designed to receive appropriate wagering indicators or settling means such as chips (not shown).

At one side of the dealer station 20, the apparatus for practicing the method of the present invention may include a microprocessor or computer controlled shuffling machine 32 supported by a table extension 34. The shuffling machine 32 may be of the type disclosed in U.S. Pat. No. 4,807,884, the disclosure of which patent is incorporated herein by reference. The shuffling machine 32 may include a dealing module for automatically and sequentially dealing cards and also may include a display means for displaying wager amounts, the identity of winning players, or other game related information, including the jackpot amount.

Figure 2:
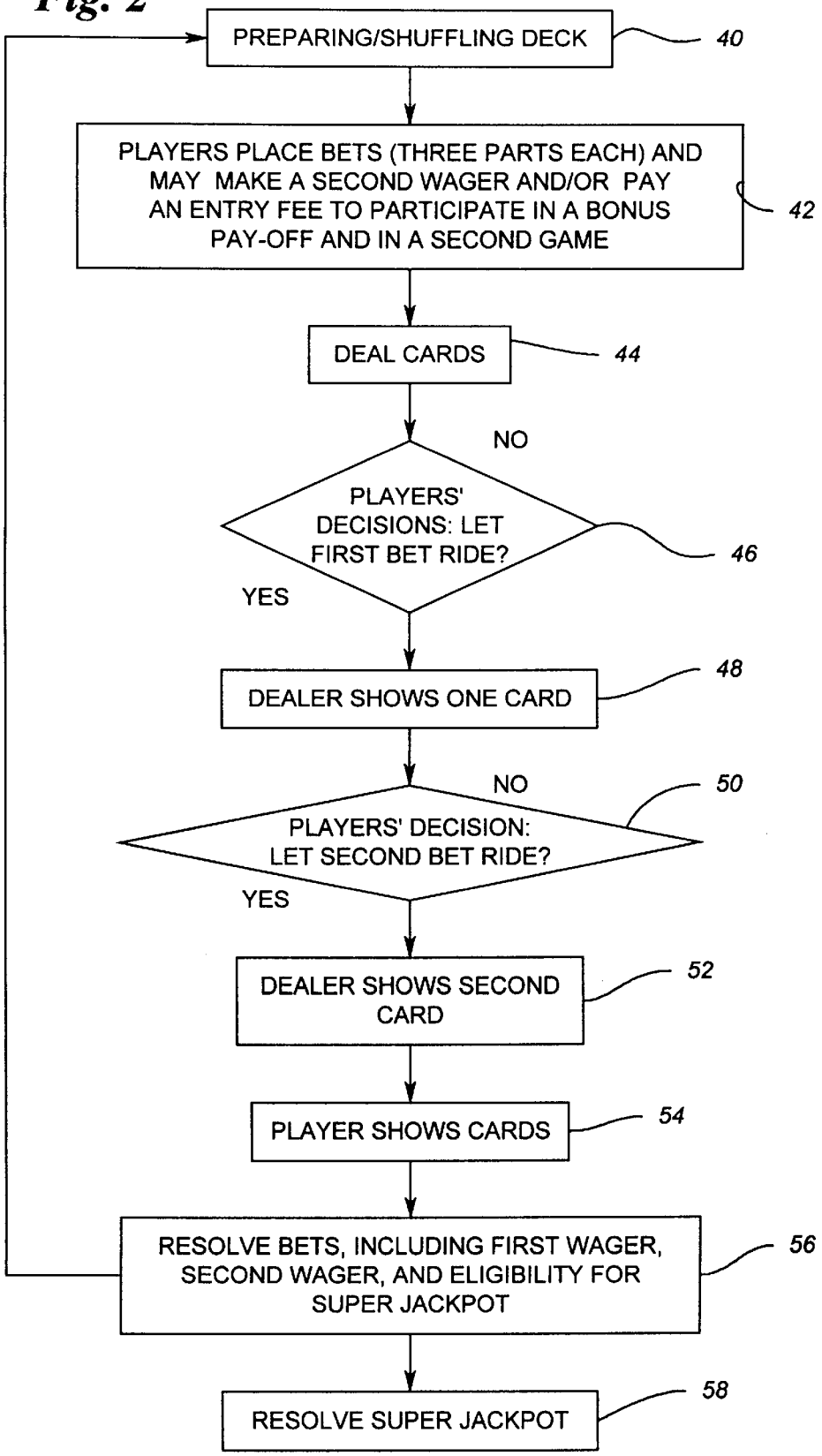
FIG. 2 is a block diagram representing the flow of play in the game.

Referring to the flow diagram of FIG. 2, the initial step in playing the basic game of the present invention is preparing or shuffling a deck of cards, represented at block 40, by activating the shuffling machine 32 or by hand-shuffling a deck to provide a shuffled deck. Next, the players place the initial wager, block 42, by putting equal amounts in each of the three betting areas 22*a, b, c*. It should be understood that variations of the preferred embodiment may include an initial wager of three unequal amounts or an initial wager having two or more portions where less than all the portions are equal. Two of the parts of this initial wager, the parts placed in wagering area 22*a* and 22*b* are retrievable at the option of the player. The third portion placed in area 22*c* is a nonwithdrawable bet. After the placing of the wager by each player, the cards are dealt, block 44, three cards being dealt down to each player and two cards are dealt down in front of the dealer.

The players inspect or "sweat" their cards in preparation for reaching decision block 46. At decision block 46, the players are queried by the dealer about whether the first part of the initial wager, the part placed in wagering area 22*a*, should be left or whether the player wishes to withdraw that portion of the bet. Each player makes the decision at decision block 46 on the basis of the three cards forming the player's incomplete hand at this point. Once each player has been queried and has decided whether or not to let the first portion of the bet ride, and those bets the player chooses to retrieve or remove are physically removed from area 22*a* and returned to the player, the dealer shows one of the down common cards, block 48. Now, each player has four cards to consider, the three cards dealt to that player originally and the single common card showing on the table. Each player must then decide whether to let the second part of the initial wager ride or whether to withdraw it from the game. After each player is queried and decides what to do with regard to the second part of the bet, and those bets to be withdrawn are physically removed from area 22*b* and returned to the player, the dealer reveals the second common down card, as represented at block 52. Each player now has a five card hand comprised of the three cards each player was originally dealt plus the two revealed common cards. The third bet, the bet placed at wagering area 22*c*, is a nonretrievable portion of the initial bet and the flow of the basic game proceeds to block 54 wherein the players show or reveal their three cards to the dealer.

The dealer resolves each player's bet (which includes all three parts, the second and third part or only the third part, depending on the player's choices during play of the hand) based on the five card hand at block 56 and determines what payout, if any, the player is entitled to receive according to the payout schedule at the particular gaming table or casino. Bets on non-winning hands are collected by the dealer or house. The hand is then over and the flow of the basic game returns to block 40, preparing and shuffling the deck for a new hand.

The award or payoff is given for each part of the initial or basic game bet that was allowed to ride to the end of the hand and for the nonwithdrawable part of the bet. A typical pay table would be as follows:

| | |
|---|---|
| Pair, Tens or Better | 1-1 (even money) |
| Two Pairs | 2-1 |
| Three of a Kind | 3-1 |
| Straight | 5-1 |
| Flush | 8-1 |
| Full House | 11-1 |
| Four of a Kind | 50-1 |
| Straight Flush | 200-1 |
| Royal Flush | 1,000-1 |

With regard to the multi-tiered wagering game and method of the present invention, along with placing their initial game wager, block 42, the players may pay an entry fee and thereby place an optional side bet or second wager of a fixed, predetermined amount to become eligible to win a bonus pay-off and to participate in a tournament playoff to become eligible to win a super jackpot. The game flow then proceeds as represented in blocks 44–56. At block 56, along with resolving players' remaining game bet, the dealer will resolve the second wager or side bet and resolve eligibility to continue in a playoff or tournament playoff to win the super jackpot. The second wager is resolved by the dealer immediately paying out a bonus payout to participating players according to a table. By immediately it is meant that the bonus payout is made at any convenient time during or at the conclusion of the game. A typical bonus pay table would be as follows:

| | |
|---|---|
| Straight | $25.00 |
| Flush | $50.00 |
| Full House | $100.00 |
| Four of a Kind | $200.00 |
| Straight Flush | $2,000.00 |
| Royal Flush | $20,000.00 |

Each player participating in the multi-tiered wagering aspect and having a final hand comprising in the preferred embodiment, the highest one hundred winning hands registered by participating player over a given period, becomes eligible to continue tournament play to win additional bonus and/or payout amounts and a super jackpot, represented at block 58. The basic wagering game and the second game may be a lottery type game, any suitable wagering game or any suitable random process through which eligible finalists are selected and through which one of the eligible finalists is identified as the super jackpot winner. The basic game and the second game which culminates in a winner of the super jackpot may be different games, and the second game may be played at a different place than the basic game.

The super prize or jackpot is a fixed amount set at least prior to the commencement of the second game and may be comprised of the optional second wager and/or entry fees, or a portion thereof, accumulated for a selected period. Where the super jackpot is comprised of accumulated second wagers and/or entry fees, or a portion thereof, the jackpot total increases until the occurrence of a selected event: the jackpot has reached a predetermined amount, a predetermined period of time has elapsed, or a predetermined number of finalists has been identified. After the occurrence of the selected event, but prior to the commencement of the second game, the jackpot amount is made known to the players. Where a fixed amount of money is allocated to fund the super jackpot prior to the commencement of the multi-tiered game, the jackpot amount can be made known to the players prior to the commencement of the basic game.

The selected period for funding a super jackpot must insure that a substantial number of players qualify for winning the super jackpot, and that a substantial jackpot, for example, a million or multi-million dollar jackpot, accumulates. Ideally, the selected period is at least one month, but a typical period would be three months, particularly if the funding program or schedule set forth below is followed. Eligible finalists in the second game, i.e., all the eligible basic game players having a final hand comprising the highest one hundred hands, are accumulated during a qualification period equal to the jackpot accumulation period. If no royal flush has been achieved during the selected accumulation period, the next highest winning hands are used to determine eligibility for the second game. Another method that could be used to determine eligible finalists in the second game would be to have each player registering a royal flush over a given time period become eligible. Once the selected event has occurred the jackpot or prize pool is established and the super jackpot amount is fixed.

A typical funding program for a super jackpot when it is comprised of accumulated fixed side bets and/or entry fees may be outlined as follows. A one dollar ($1.00) fixed second wager and/or entry fee could be required to participate in the bonus pay-off and the second game. Of this amount, forty-five cents (0.45) could be used to fund immediate bonus payouts to players, the bonus payouts being based on a random outcome or certain poker rankings as set forth above. Fifty-five cents (0.55) could be used to fund the super jackpot. It should be understood that the preceding numbers are used only for example and that the actual numbers could be varied greatly. Also, a portion of the fixed side bets and/or entry fees could be used for other purposes, such as to cover other expenses and contribute to profits.

The multi-tiered game and method of the present invention is not limited to being played with five card stud poker games, but may be applied or used with other appropriate wagering games such as other poker games or games of chance (e.g., Twenty-one, Blackjack, Seven card stud, roulette, craps, slots, video poker, and game machines or computers using gaming software or linked to a network, such as the Internet, having gaming programs). The method of the present invention does not require a shuffling machine 32, dealing module 33 or a display means 36. However, when the multi-tiered wagering game is played with a card game, these features facilitate and expedite the play of the game as well as add security (game protection), efficiency and interest. The fee for participation in the second game of the present invention may be in an amount other than one dollar, and the funding schedule set forth above may be varied. Where the super jackpot is funded by accumulated fixed second wagers and/or entry fees, the accumulation period may also be varied, as long as a jackpot sufficient to interest players accumulates. For example, the accumulation period may be a selected time period, may be based on the accumulation of a particular amount of money, or may be based on the accumulation of a certain number of finalists.

The following instructions set forth the conceptual design and procedures for a tournament in a casino environment incorporating the preferred embodiment of the present invention and wherein the jackpot is funded by a portion of the accumulated entry fees:

Before the basic LET IT RIDE® game is played, players may elect to pay a $1 entry fee per hand to participate in the LET IT RIDE® Tournament. If they pay the entry fee and get a straight or higher, they will be eligible for bonus payments as follows:

| | |
|---|---|
| Royal Flush | $20,000 |
| Straight Flush | $2,000 |
| Four of a Kind | $200 |
| Full House | $100 |
| Flush | $50 |
| Straight | $25 |

For example: If a player makes three $5 bets on the LET IT RIDE® game and hits four of a kind, he will receive $750 for that bet (50 to 1). If he had also paid the $1 tournament entry fee for that hand, he would receive a $200 bonus for a total payout of $950.

If a player hits a royal flush, he will be paid 1,000 to 1 for his basic bet. Again, using three $5 bets as an example, the player would win $15,000 for his basic bet and, if he had paid the $1 tournament entry fee for that hand, he would receive a $20,000 bonus for a total payout of $35,000.

The hit frequency shows that 45¢ of the $1 entry fee will be required to finance the bonus payment schedule. The remaining 55¢ will be put into the super jackpot pool.

The first round of the tournament will last for a predetermined length of time (e.g., three months). At the end of that period, the players with the one hundred highest hands (plus ties) will qualify for round two of the tournament. Rounds two through five (the final round) would take place over a two day period at a host casino. All of the qualifiers that return and participate in round two of the tournament will receive a bonus (i.e., $5,000) regardless whether they win or lose.

Two Day Playoff

Day One/Round Two—Each player will be given an equal amount of nonredeemable chips in various denominations. At the end of 50 hands, the 50 players (plus ties) with the highest winnings will advance to round three and will receive another bonus (i.e., $10,000).

Day One/Round Three—The 50 remaining players will reassemble at thetables and again be issued an equal amount of non-redeemable chips. The winnings from the previous round will not be carried forward. After 50 hands have been played, the 25 players (plus ties) with the highest winnings will advance to round four and receive another bonus (i.e., $15,000).

Day Two/Round Four—The 25 remaining players will return to the tables and will be issued an equal amount of chips. After 50 hands, the five players with the most money will advance to round five (the final round). Since the final round cannot have more than five players, a ten hand tie-breaker round will be played between players trying for the fifth seat.

Day Two/Round Five (Final Round)—The five finalists will receive an equal number of chips and play at the same table. At the end of 50 hands, the players are ranked according to the total value of the chips they have accumulated. The payouts will be distributed as follows:

| | |
|---|---|
| 5th Place | $1,000,000 |
| 4th Place | $1,500,000 |
| 3rd Place | $2,000,000 |
| 2nd Place | $2,500,000 |
| lst Place | Fixed amount larger than second place or balance of super jackpot pool |

The balance is the balance of the super jackpot pool after all other prizes have been deducted. While this balance is not fixed at the beginning of play of the basic game it is fixed prior to the beginning of round two of tournament play. The payout numbers are for illustration only and in actual practice could be higher or lower.

Irregularities in The Tournament

1. At the end of each round, only players with chips remaining are eligible for the next round, e.g., if only forty players have chips remaining after round two, then only those forty players may advance to round three.
2. If, during the final round, several players lose all of their chips before the round is over, they will be ranked in the order they lost their chips, e.g., the first player to lose all his chips will take seventh place, the second player to lose his chips will be in sixth place, etc.
3. If two or more players lose their chips on the same hand, those players will tie and the prize money will be divided equally, e.g., if the first two players to lose all of their chips do so on the same hand, they would tie for fourth place. The prize money for the 4th and 5th places would be added together and divided equally among the two players.

Dealing Procedures

1. Before proceeding with each hand, the dealer asks "any tournament entries?" and allows each player time to place his entry fee in the designated area. The player may place either his basic game wager, or his optional wager and/or tournament entry fee on the table first—the order does not matter.
2. The dealer ensures that the red entry fee lamp, or other suitable display means, on the gaming table is on for each player who has placed an optional wager and/or an entry fee.
3. The dealer then verifies the accuracy of each player's bet by confirming that an amount is placed on each of the three wagers.
4. The dealer now touches a "no more fees" switch on the table control panel. Once this is done, players may not change their wagers or entry fees in any way.
5. The dealer collects the optional wagers and/or entry fees and places them in the chip rack. (Without the dealer having to take any action, once the last coin from the optional wagers and/or entry fees is collected, a signal is sent to the shuffler and it automatically moves the freshly shuffled deck forward to the pre-count counting position.)
6. The dealer takes the deck from the discard rack and places it in the shuffling area of the automatic shuffler. (Once the cards are placed in the shuffling area, the shuffler automatically counts the first three cards into the forward position.)
7. The dealer takes the three cards from the front of the shuffler and places them face down on the table in front of the first player on his left, spreading the cards to verify that exactly three cards were dealt.
8. The dealer now takes the next three cards from the front of the shuffler and places them face down in front of the second player from his left, spreading them out to verify the number of cards. The dealer follows this procedure clockwise around the table until each player who has made a wager receives a three card hand.
9. After each player has received three cards, the dealer places the next three cards from the shuffler face down in front of himself. (Although only two cards are used, the automatic shuffler is programmed to dispense three cards). These cards remain in a stack so that the two bottom cards are hidden by the top card. The stack is placed in the left hand rectangle of the two rectangles on the layout in front of the dealer.
10. The dealer touches the "card count" switch on the shuffler. The shuffler counts the remaining cards while moving them to the forward position. Before the dealer picks up the cards, he must determine whether or not the count is accurate. If the card count light glows green, the count is accurate. If the card count light flashes red, there is a miscount.
11. In case of a flashing red light, the dealer calls a floor supervisor for instructions before proceeding. (see "irregularities" below.)
12. If the card count light glows green, the dealer may remove the balance of the cards from the shuffler and place them in the discard rack.
13. While waiting for the card count light, the dealer begins the round with the first player on his left. The dealer allows each player in turn the option to reclaim his first portion of the basic game wager or leave it. The dealer must not allow players to reach out and retrieve their own bets. If a player does this, the dealer should politely ask him not to do so in the future. Only the dealer can return bets to a player.
14. After the first round of options, the dealer takes the top card from the stack in front of him and places it on top of the cards in the discard rack. Then he turns over the second card, placing it face up covering the bottom card. The bottom card should not be visible.
15. Again, starting on his left, the dealer gives each player in turn the option to reclaim his second portion of the basic game wager or leave it. The dealer asks the players to place their hands face down either near, against, or under their chips until the hand is over.
16. The dealer moves his up card to the right hand rectangle on the layout in front of him. The dealer then turns over his bottom card. There should now be two up cards in front of the dealer representing the community cards for the players.
17. Starting with the player on his right, the dealer turns over that players hand and determines if it is a winning hand according to the payout schedule for the basic LET IT RIDE® game. If the player does not have a winning hand, the dealer collects the remainder of the player's basic game wager and places it in the chip tray. If the player does have a winning hand according to the LET IT RIDE® payout schedule, the dealer pays the player the amount indicated on the schedule.
18. To determine the bonus payment, the dealer touches the key on the control panel which indicates the player's position (the light will begin to flash). The dealer touches the key representing the player's hand. The dealer touches the enter key. The dealer then looks at the instruction window for the next step (i.e., whether to pay the player or notify a floor supervisor, what amount to pay, etc.).
19. Once a bonus has been paid to a player and approved by the appropriate casino authorities, the dealer collects that player's cards and places them face down in the discard rack. The dealer touches the enter key again. The dealer then moves on to the next player from his right (counter-clockwise) and follows the same procedures outlined in steps 18 through 21.
20. When the dealer finishes with the last player (the first player on his left), he collects those cards and the two community cards in front of the dealer and places them face down in the discard rack. The dealer then touches the "game over switch" on the control panel.

Irregularities in Dealing Procedures

1. Entry Fee Light

If a player puts up his $1 wager (in the form of a metal gaming token provided by the casino) for his optional wager and/or entry fee and his entry fee light does not activate, the dealer calls a floor supervisor for instructions.

The supervisor then closes that position for play.

2. Too Many or Too Few Cards in Deck

If the automatic card count light on the shuffler is flashing red after it has counted out the cards, the dealer calls a floor supervisor. The floor supervisor removes the cards from the discard rack and does a hand count on the table (adding in the cards that have been dealt to the players) to determine whether the card count is accurate. If the count results in fewer or more than 52 cards, the round is declared a misdeal and all of the cards are collected. The floor supervisor removes the deck from the game and seals it to be held for further examination, if necessary. The supervisor then installs a new deck of the same color following the new deck dealing procedures.

3. Auto Shuffler Miscount

Even if the automatic shuffler shows an accurate count, if any player has more or less than three cards, it is still considered a misdeal and a dead hand. The deck is removed and a floor supervisor is called.

4. Player Has Too Many or Too Few Cards In His Hand

If any player has too many or too few cards (more or less than three) in their hand, the round will be declared a misdeal. The cards will be collected and new hands will be dealt from a new deck.

Bonus Payments and How To Pay Them

If a player has paid the $1 optional wager and/or entry fee and his hand consists of a straight or higher, he is eligible for the following cash bonus payments:

| | |
|---|---|
| Royal Flush | $20,000.00 |
| Straight Flush | $2,000.00 |
| Four of a Kind | $200.00 |
| Full House | $100.00 |
| Flush | $50.00 |
| Straight | $25.00 |

If a player has a straight ($25) or a flush ($50), the dealer pays the bonus from the chip tray upon verbal approval of the floor supervisor.

If a player has a full house ($100) or four of a kind ($200), payment is made upon approval of the pit boss.

If a player has a straight flush ($2,000) or a royal flush ($20,000), approval of the pit boss and the shift supervisor or casino manager is required before making payment.

Optional Wager and/or Entry Fee

Amount: $1 per hand paid prior to receiving cards.
Token: $1 value metal gaming token provided by the casino.

Since the object of round one of the tournament is to get one of the hundred highest hands dealt during the posted time period, players may enter every time they play the basic LET IT RIDE® game.

Fifty-five cents of each $1 entry fee collected by the casino is remitted to the tournament organizer. The remaining 45¢ is retained by the casino. Each casino is responsible for paying any bonuses the entrants may qualify for during round one. If the bonus awards paid by a casino are less than the amount collected, the casino is entitled to keep the money as its own. If the bonus awards paid out exceed the money collected by the casino, the casino must make up the difference.

The 55¢ remitted to the tournament organizer is deposited into a holding account. This money constitutes the prize money available to be paid to players as they advance to rounds two through five.

Qualifying Hands

Only the player who receives a qualifying hand is allowed to advance to rounds two through five. Qualifiers for any round may not sell, donate, or in any way transfer their rights to continue in the tournament.

If a qualifier is unable to continue in the tournament for any reason whatsoever—including death—no one will be allowed to substitute for that person and continue in his place. (This rule is intended for the protection of the tournament qualifiers as well as the integrity of the tournament.)

If a player has more than one qualifying hand, only his or her highest hand will be allowed to advance to round two.

A qualifying hand may not be used in any tournament other than the one in which it is received.

Registering Qualifying Hands

In addition to the normal IRS paperwork, all straight flush and royal flush bonus winners must complete "LET IT RIDE® Bonus Winner Form" paperwork. If a player does not complete this form, he will not be considered a qualifier for round two.

Variations

The multi-tiered wagering game of the present invention, including the "LET IT RIDE®" game aspects thereof, might be played live with a dealer at one or more gaming tables in one or more casinos, or in casinos, homes and other locations in interactive electronic or video form with automatic coin or betting means symbols, receptacles and payout capability, wherein appropriate symbols for cards, wagers or score keeping would be displayed electronically.

A number of variations of the present invention can be made. For example, the payout schedules can be significantly varied from the "typical pay tables" previously disclosed. One variation, where each coin is the equivalent of One Dollar ($1.00) and two pay tables are used, could be as follows:

Variation No. 1

| | Payout Schedule A Basic Game where "Let It Ride ®" game is played First Wager | | | Payout Schedule B Optional Game or Games Second Wager or Entry Fee |
|---|---|---|---|---|
| | 1 coin | 2 coins | 3 coins | 1 coin |
| Royal Flush | $1,000 | $2,000 | $3,000 | $10,000 + advance to tournament playoff |
| Straight Flush | 200 | 400 | 600 | 8,000 |
| Four of a Kind | 50 | 100 | 150 | 5,000 |
| Full House | 25 | 50 | 75 | 0 |
| Flush | 10 | 20 | 30 | 0 |
| Straight | 5 | 10 | 15 | 0 |
| Three of a Kind | 3 | 6 | 9 | 0 |
| Two Pair | 2 | 4 | 6 | 0 |
| Tens or Better | 1 | 2 | 3 | 0 |

Where the above table identifies "basic game" winnings, this amount can be one of three amounts depending on the number of coins the player withdraws from play. If, for example, a player withdraws one coin while playing the LET IT RIDE® game, has made the optional second wager or entry fee, and draws a straight flush, that player wins $8,400.00 ($400.00+$8,000.00 bonus), but does not become eligible to play in a tournament playoff having a super jackpot prize. Thus, in this example, the payout resolution of the basic or first game wager is proportional to the size of the wager. However, the payout resolution of the second wager and/or entry fee is disproportionate to the size of the wager. By way of further example, a player that does not withdraw any coins while playing the LET IT RIDE® game, that has made the optional second wager or entry fee, and that draws a royal flush wins $1,000.00 for each One Dollar bet as part of the first wager and wins $10,000.00 and advances to further tournament play for the One Dollar bet as a second wager. By drawing a royal flush, the player making a second optional wager or an entry fee wins an immediate and disproportionately large amount of cash (i.e., $10,000 as opposed to $1,000) and the possibility of even further future winnings during tournament play.

Another variation, where only one pay table is provided, could be as follows:

Variation No. 2

Payout Schedule

| | Basic Game where "Let It Ride ®" game is played First Wager 1 coin | 2 coins | 3 coins | Optional Game or Games Second Wager and/or Entry Fee 4 coins | Total |
|---|---|---|---|---|---|
| Royal Flush | $1,000 | $2,000 | $3,000 | basic game winnings + $10,000 + advance to tournament playoff | basic game winnings + $10,000 + advance to tournament playoff |
| Straight Flush | 200 | 400 | 600 | basic game winnings + $8,000 | basic game winnings + $8,000 |
| Four of a Kind | 50 | 100 | 150 | basic game winnings + $5,000 | basic game winnings + $5,000 |
| Full House | 25 | 50 | 75 | 0 | basic game winnings |
| Flush | 10 | 20 | 30 | 0 | basic game winnings |
| Straight | 5 | 10 | 15 | 0 | basic game winnings |
| Three of a Kind | 3 | 6 | 9 | 0 | basic game winnings |
| Two Pair | 2 | 4 | 6 | 0 | basic game winnings |
| Tens or Better | 1 | 2 | 3 | 0 | basic game winnings |

As seen when comparing the pay tables labeled Variation No. 1 and Variation No. 2, the payout amounts are identical. The only difference is in the presentation to the players. The concept of providing a player with a disproportionate payout based on the last coin wagered in a series of coins wagered is sometimes referred to as the "maximum coin concept."

Still another variation is a payout schedule that does not include both a bonus and qualification for a tournament playoff. One example, where the basic game is not the LET IT RIDE® game and where the players qualifying for play at a next level are guaranteed a disproportionate payout at the next level, would be as follows:

Variation No. 3

Payout Schedule

| | 1 coin | 2 coins | | Total | |
|---|---|---|---|---|---|
| Royal Flush | $1,000 | $2,000 | + Qualification for next level | $2,000 | + Qualification for next level |
| Straight Flush | 200 | 400 | + Qualification for next level | 400 | + Qualification for next level |
| Four of a Kind | 50 | 100 | | 100 | |
| Full House | 25 | 50 | | 50 | |
| Flush | 10 | 20 | | 20 | |
| Straight | 5 | 10 | | 10 | |
| Three of a Kind | 3 | 6 | | 6 | |
| Two Pair | 2 | 4 | | 4 | |
| Tens or Better | 1 | 2 | | 2 | |

A player wagering two coins and drawing a royal flush in this example wins $1,000.00 based on the first coin wagered, and wins $1,000.00 and becomes eligible to play in a tournament playoff having a super jackpot prize based on the optional second coin wagered. Although there is no disproportionate bonus payout provided for in this variation, all of the qualifiers or finalists for play at the next level are guaranteed a disproportionate future payout in the continuing play.

As can be seen in the above examples, an embedded event which triggers a reward is linked to the optional second wager or entry fee. More specifically, in one embodiment the reward can include a disproportionate bonus payout and advancement to continuing play, or advancement to continuing play which guarantees a disproportionate payout, or a combination of the foregoing. It should be understood that the optional wager or fee can be the last of any series of wagers or fees and that the reward can be any prize, payout, or change-in-position.

Still another variation includes providing three resolutions based on one wager (the payout based on the basic wager, an amount in addition to the basic wager payout, and eligibility to win a jackpot payout).

As in any of the examples used herein, the payout numbers are for illustration only and in actual practice could be higher or lower, as long as the workability of the game method and its attractiveness to players are not adversely affected.

The present invention may be embodied in other specific forms without departing from the essential attributes thereof. It is desired that the embodiments described above be considered in all respects as illustrative, not restrictive, reference being made to the appended claims to indicate the scope of the invention.

What is claimed is:

1. A method for playing a wagering game involving a player, characterized by a basic game and a basic game payoff, an accumulation of players eligible to win a jackpot and a jackpot payoff, comprising the steps of:

placing a basic wager to become a participant in the basic game;

playing the basic game;

resolving the basic wager based on the outcome of the basic game, wherein if a player meets a range of game conditions, that player wins an amount;

further wherein if a player meets a predetermined narrower subset of the range of game conditions, that player becomes eligible to win the jackpot; and playing a second game to select a winner of the jackpot from an accumulation of players eligible to win the jackpot.

2. The method according to claim 1, wherein the amount includes the basic game payoff.

3. The method according to claim 1, wherein the jackpot payoff is disproportionate to the basic game payoff.

4. The method according to claim 1, wherein the amount includes the basic game payoff and a bonus.

5. The method according to claim 1, wherein said jackpot is a fixed amount.

6. The method according to claim 1, wherein said jackpot is formed by an accumulation of a portion of said entry fee.

7. The method according to claim 6, wherein said jackpot amount is fixed prior to the commencement of said second game.

8. The method according to claim 1, wherein said second game is a playoff or tournament.

9. The method according to claim 1, wherein the size of the first wager may be optionally and selectively varied by the player, and the preselected amount varies according to the size of the wager.

10. The method according to claim 1, wherein the wagering game is poker, wherein the predetermined arrangement of cards is a pair of tens or better, two pairs, three-of-a-kind, a straight, a flush, a full house, four-of-a-kind, a straight flush or a royal flush, wherein the subset of the predetermined arrangement is a straight, a flush, a full house, four-of-a-kind, a straight flush or a royal flush, and wherein the narrower subset is a designated number of the highest hands, including ties, selected from said subset.

11. The method according to claim 1, wherein the wagering game is poker, wherein the predetermined arrangement of cards is a pair of tens or better, two pairs, three-of-a-kind, a straight, a flush, a full house, four-of-a-kind, a straight flush or a royal flush, wherein the subset of the predetermined arrangement is a straight, a flush, full house, four-of-a-kind, a straight flush or a royal flush, and wherein the narrower subset is a royal flush.

12. A method for playing a series of games involving a plurality of players, characterized by a basic game, a basic game payoff, an accumulation of players eligible to win a jackpot and a jackpot, comprising the steps of:

placing a wager to become a participant in the basic game;

playing the basic game;

resolving the wager based on an outcome of the basic game, wherein if a player meets one of a range of identified games outcomes, that player wins an amount in addition to the basic game payoff, and if a player meets a predetermined narrower subset of the range of identified game outcomes, that player becomes eligible to win the jackpot; and playing a second game to select a winner of the jackpot from the accumulation of players eligible to win the jackpot.

13. The method according to claim 12, wherein the amount in addition varies according to which one of the range of identified game outcomes a player meets.

14. A method for playing a wagering game involving a player, the game characterized by a basic game payoff, a jackpot payoff and an accumulation of players eligible to win a jackpot and comprising the steps of:

placing a wager to become a participant in the basic game;

playing the basic game;

resolving the wager based on an outcome of the basic game, and wherein depending on said outcome of the basic game, the participant wins an amount in addition to the basic game payoff and becomes eligible to win the jackpot payoff; and playing a second game to select a winner of the jackpot payoff from the accumulation of players eligible to win the jackpot payoff.

15. The method according to claim 14, wherein the size of the wager may be optionally and selectively varied by the player, and the amount in addition varies according to the size of the wager.

16. The method according to claim 15, wherein the amount in addition also varies according to the outcome of the basic game.

17. The method according to claim 14, wherein the basic game is a lottery game.

18. The method according to claim 17, wherein the size of the wager may be optionally and selectively varied by the player, and the amount in addition varies according to the size of the wager and to the outcome of the basic game.

19. The method according to claim 14, wherein the second game comprises a series of games.

20. A method for playing a series of games involving a plurality of players, characterized by a basic game payoff, an accumulation of players eligible to win a jackpot and a jackpot, comprising the steps of:

placing a wager to become a participant in the basic game;

paying an entry fee to become a participant eligible to win the jackpot;

playing the basic game;

resolving the wager based on the outcome of the basic game, wherein if a player meets a range of identified game outcomes, that player wins the basic game payoff;

resolving the entry fee, wherein if a player meets a predetermined narrower subset of the range of identified game outcomes, that player becomes eligible to win the jackpot; and playing a second game to select a winner of the jackpot from an accumulation of players eligible to win the jackpot.

21. The method according to claim 20, wherein the second game comprises a series of games.

22. A method for playing a game including a basic game payoff, a bonus payoff and a tournament, comprising the steps of:

placing a first wager to become a participant in the basic game;

placing an optional second wager to become eligible for possible participation in the tournament;

playing the game to an outcome;

resolving the first wager and making the basic game payoff based on the outcome and the amount of the first wager, wherein if the outcome is an identified outcome, a player wins the bonus payoff which varies in size according to the outcome;

resolving the optional entry fee, if paid, based on the outcome, wherein if the outcome is a selected outcome, a player becomes eligible to participate in the tournament; and playing the tournament to select a tournament winner.

23. The method according to claim 15, wherein the size of the first wager may be optionally and selectively varied by the player.

24. A method for playing a wagering game, characterized by a basic game, a basic game payoff and a jackpot payoff, comprising the steps of:

placing a basic wager to become a participant in the basic game;

paying an entry fee to become a participant eligible to win the jackpot payoff;

playing the basic game;

resolving the basic wager based on the outcome of the basic game, wherein if the participant meets a range of game conditions, the participant wins an amount in accordance with a payable in turn based on a proportionate payout;

resolving the entry fee, wherein if the participant meets a predetermined narrower range of game conditions, the participant becomes eligible to win the jackpot payoff; and playing a second game to select a winner of the jackpot payoff.

* * * * *